United States Patent [19]

Citrowske

[11] Patent Number: 4,779,362

[45] Date of Patent: Oct. 25, 1988

[54] WALKING SOLE AND CARRIER ASSEMBLY FOR RIGID-BOTTOMED FOOTGEAR

[76] Inventor: Owen A. Citrowske, 2817 W. Claremont, Phoenix, Ariz. 85017

[21] Appl. No.: 73,055

[22] Filed: Jul. 13, 1987

[51] Int. Cl.[4] ..... A43B 5/04; A43D 5/00

[52] U.S. Cl. ..... 36/132; 36/117; 12/120.5

[58] Field of Search ..... 36/132, 7.5, 136, 117; 12/120.5

[56] References Cited

U.S. PATENT DOCUMENTS

| | | | |
|---|---|---|---|
| 3,210,787 | 10/1965 | Allsop . | |
| 3,397,416 | 8/1968 | Celli | 12/120.5 |
| 3,590,410 | 7/1971 | Shields | 12/120.5 |
| 3,665,620 | 5/1972 | St. Clair . | |
| 3,971,144 | 7/1976 | Brügger-Stucker . | |
| 4,160,301 | 7/1979 | Woolley | 12/120.5 |
| 4,199,880 | 4/1980 | Frey | 36/132 |
| 4,228,602 | 10/1980 | Groves . | |
| 4,461,104 | 7/1984 | Calkin et al. | 36/132 |

FOREIGN PATENT DOCUMENTS

| | | | |
|---|---|---|---|
| 2506751 | 8/1976 | Fed. Rep. of Germany | 36/117 |
| 2719078 | 11/1978 | Fed. Rep. of Germany | 36/117 |
| 580927 | 10/1976 | Switzerland | 36/132 |

*Primary Examiner*—James Kee Chi

*Attorney, Agent, or Firm*—Louise S. Heim

[57] ABSTRACT

A walking sole and carrier assembly comprises a pair of walking soles for mounting beneath rigid-bottomed footgear such as ski boots, and a detachable handle for joining the soles in side-by-side relationship to one another so that they form a carrier or boot tree. The lower tread face of each walking sole includes a planar rear surface and a planar front surface which defines an obtuse angle with respect to the rear surface. The junction between the front and rear surface is a straight line, which allows the wearer to rock abruptly from the rear surface to the front surface, simulating the natural action of a foot bending at the ball, and duplicating the toe flexing which would be performed by the back foot during ordinary walking, but which is prohibited by the rigid bottoms of the footgear.

11 Claims, 1 Drawing Sheet

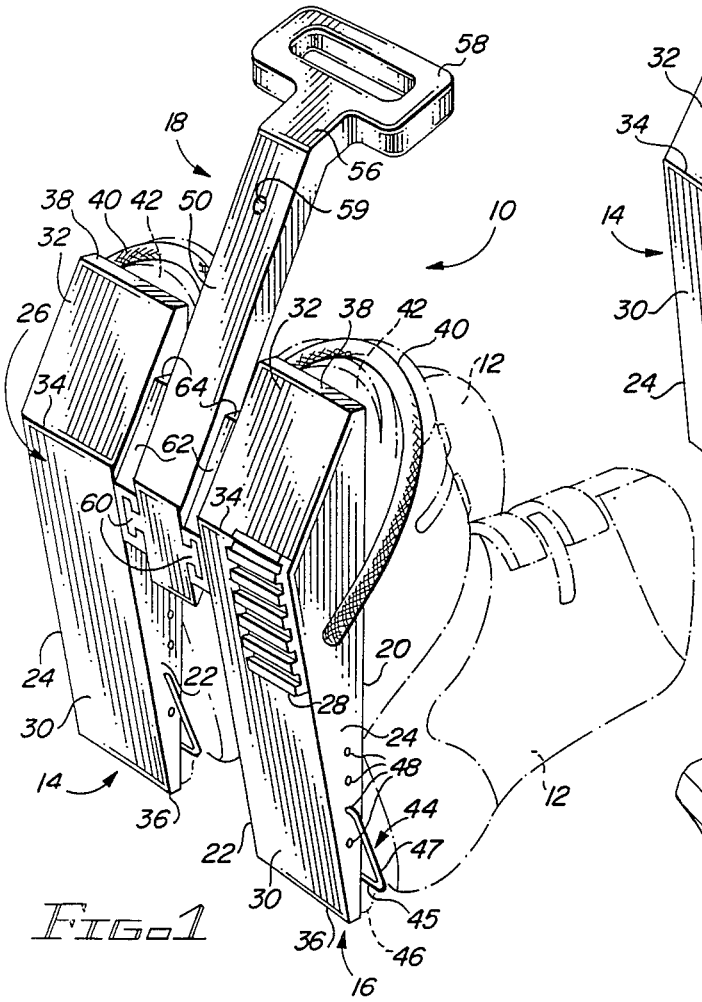
FIG. 1
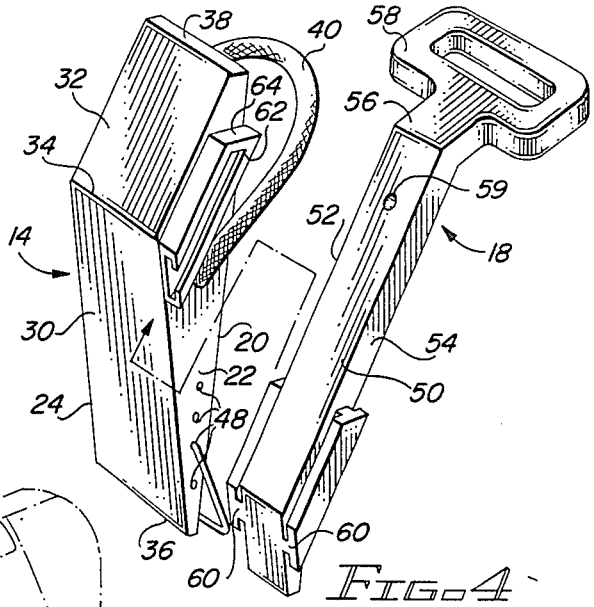
FIG. 4
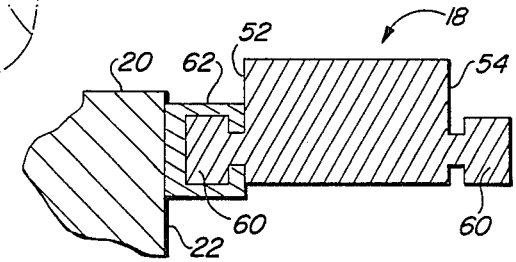
FIG. 5
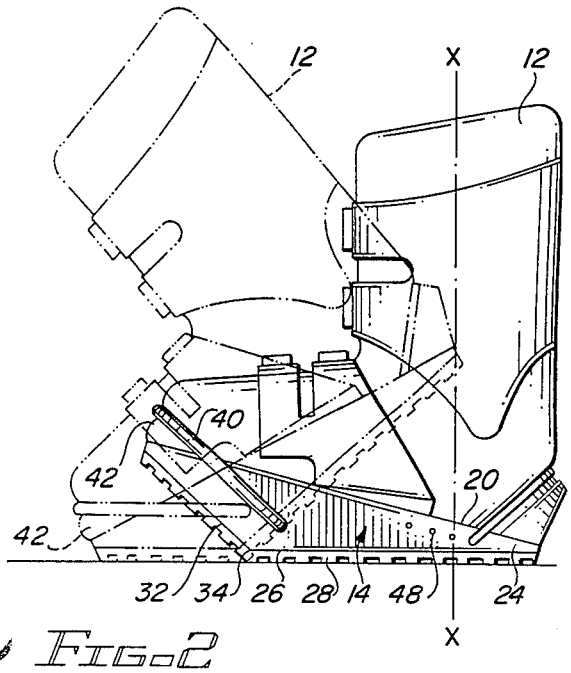
E22 FIG. 2
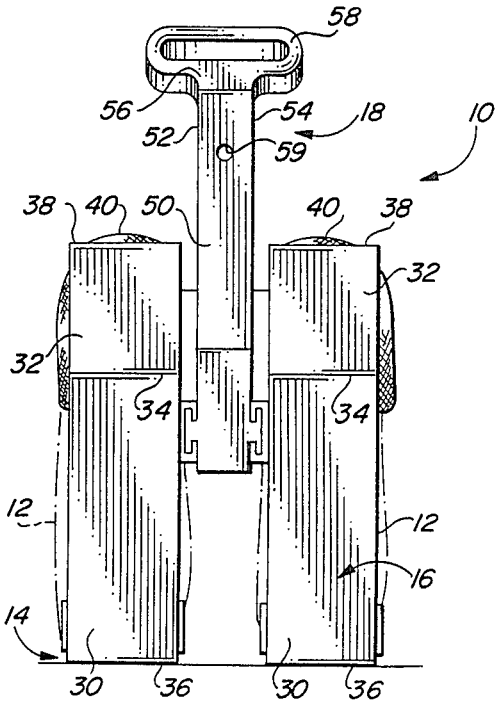
FIG. 3

WALKING SOLE AND CARRIER ASSEMBLY FOR RIGID-BOTTOMED FOOTGEAR

BACKGROUND OF THE INVENTION

1. Field of the Invention

This invention relates in general to footgear accessories and, more particularly, to a pair of improved "walking soles" for use with rigid-bottomed footgear such as ski boots. The walking soles include means for attaching a handle in order to convert them into a boot tree or carrier assembly.

2. Description of the Prior Art

The sport of skiing requires specifically configured boots which enable the skier to assume a correct skiing posture, in which the knees are slightly bent while the upper body is disposed substantially perpendicular to the ground. Typically, these boots comprise a flat, substantially inflexible sole portion arranged for cooperation with the top flat surface of a snow ski, and an upper portion which extends angularly forwardly at the skier's ankle. The sole portion includes front and rear projecting ledge portions arranged for releasable engagement by toe and heel pieces, respectively, of a ski binding mechanism arranged to securely mount the boot removably to a ski during use. The upper portion includes buckles or other fasteners for tightening the boot about the skier's ankle and lower leg.

Unfortunately, although this boot configuration is ideal for a skier on the slopes, it does not allow a person to walk comfortably about once his or her skis have been removed. The wearer's discomfort in walking is due both to the stiffness of the sole portions of the boots, which prevent the toes from flexing and the foot from bending at the ball as in normal walking movements, and to the angled configuration of the upper portions of the boots, which prevents the skier from unbending at the knee. The wearer's discomfort can be alleviated to some degree by unfastening the upper, ankle supporting portion of the boots in order to enable the leg to move independently within. However, this tends to break down the integrity of the upper portions, and often results in chafing and blistering of the leg and heel.

Very often, skiers attempt to avoid the problems of walking in their boots by bringing along an extra, more comfortable pair of walking shoes or warm-up boots which they change into before and after skiing. Typically, the skier arrives at the ski area wearing the more comfortable footgear and carrying the ski boots on a boot tree having automatically adjustable heel and toe retainers for mounting the boots in a sole-to-sole configuration. Then, upon arriving, he or she changes into the ski boots and mounts the comfortable footgear on the boot tree for storage in a locker. However, most people find that the practice of changing shoes every time the skier takes a break, such as to go to the warm-up lodge, the cafeteria, or the rest rooms, is timeconsuming and inconvenient.

Various attempts have been made in the past to eliminate the need for an extra pair of comfortable boots or shoes by providing a special "walking sole" which can be detachably mounted on the bottom surface of ski boots to permit the wearer to walk comfortably upright on foot. Two such attempts are described in U.S. Pat. No. 4,228,602 to Groves and U.S. Pat. No. 4,461,104 to Calkin et al. In both cases, the walking sole comprises a body portion having a generally flat upper face and a longitudinally curved lower trend face, with the body portion being thickest just below the ball of the wearer's foot. Attachment means are provided on the front and rear of the body portion to engage the toe and the heel, respectively, of the wearer's ski boot. While wearing walking soles of this type, a skier can walk in a substantially normal fashion simply by shifting his or her weight forwardly and causing the boot to rock about the thickest curved area in a manner similar to a foot bending at its ball.

Both the sole of Groves and the sole of Calkin et al suffer from a number of drawbacks. One drawback is storage and transportation, since the soles must be carried separately and stored in a locker or other safe location, in addition to the owner's boot tree and other assorted equipment. Another problem is that the curvature of the bottom of the soles provides a certain amount of resistance to the skier's rocking movement about the thickest portion, and thus increases the stress on the skier's foot, especially when walking uphill. In addition, the front and rear attachment means on both of these prior art walking soles are rather complex, spring-loaded or manually adjustable mechanisms which require a certain degree of sophistication on the part of the user, and which could easily malfunction in freezing conditions or when clogged by ice or snow or the like.

Accordingly, a long-felt need exists for a new and useful walking sole and carrier assembly for rigid-bottomed footgear such as ski boots.

SUMMARY OF THE INVENTION

In accordance with the present invention, a pair of walking soles for use with rigid-bottomed footgear such as ski boots is provided wherein each sole has an improved bottom configuration for facilitating walking and alleviating stress in the wearer's feet. In addition, means for attaching a handle is provided in order to convert the pair of walking soles into a carrier assembly.

Each walking sole of the pair comprises a body portion having a generally flat upper face, a pair of opposite side walls, and a lower tread face. The lower tread face includes a planar rear surface which normally extends horizontally along the ground, and a planar foot surface which defines an obtuse angle with respect to the rear surface. The junction between the two surfaces is a straight line located just below the ball of the wearer's foot. The thickness of the body portion of the sole increases linearly from the rear edge of the body portion to the junction line, and then decreases linearly from the junction line to the front edge of the body portion. This ensures that when the wearer stands in a stationary position with the planar rear surface of the lower tread face resting on level ground, the front portion of his or her feet will be elevated relative to the rear portion, thus compensating for the angular orientation of the upper portions of the boots with respect to the lower portions. Therefore, the wearer is able to stand comfortably in an upright position with his or her legs perpendicular to the ground and knees bent.

In order to walk, the wearer shifts his or her weight in a forward direction in the same manner as when taking a normal step, thus causing the sole to rock about the bottom junction line. Because the transition between the rear and front surfaces of the lower tread face is abrupt rather than gradual, as in prior art walking soles, the sole actually rocks or teeters, rather than rolls, about the junction line. This rocking or teetering movement reduces the amount of resistance the wearer must overcome when shifting his or her weight to take a step, and consequently reduces the amount of stress on each foot. This is especially advantageous when walking uphill, since a wearer only has to overcome the resistance provided by the slope of the hill and not the resistance of both the hill and the curved tread face, as was the case with the prior art walking soles.

In order to mount each walking sole securely on to the bottom of one of the wearer's ski boots, toe attachment means are provided on the forward part of the walking sole body portion for releasably engaging the toe binding ledge of the boot, and heel attachment means are provided on the rear portion of the body portion for releasably engaging the heel binding ledge of the boot. Preferably, the toe attachment means comprises a cord of strong, resilient material which is secured to the body portion in a suitable fashion. The central portion of the cord defines a loop which is stretched over the toe binding ledge of the boot, so as to tightly hold the front portion of the boots in place. The heel attachment means preferably comprises a rigid bail member, the central portion of which is adapted to engage the heel binding ledge of the ski boot. A plurality of spaced apart apertures is formed at spaced apart intervals in the sides of the walking sole body portion, for removably and pivotably receiving the opposite ends of the bail member. Thus, the walking soles can be adapted to fit different sized ski boots simply by moving the ends of the bail member into a different set of apertures closer to or farther away from the rear edge of the sole.

A detachable handle is provided for converting the pair of walking soles into a carrier assembly or boot tree. Preferably, the handle comprises an elongated lower portion having spaced apart opposite side walls, each of which is adapted for connection to the inner side wall of a different one of the walking soles, and an angularly disposed upper portion having a hand grip formed at its distal end. The means for connecting the outer side walls of the handle to the inner side wall of each of the walking soles comprises a rail member which runs along each of the sides of the lower portion of the handle. A channel member defining a mating slot is provided on the inner side wall of each walking sole for slidably receiving a corresponding one of the rail members. The forward end of each channel member is closed off by means of a stop wall which prevents the handle from being pulled out by a person lifting the assembly by the hand grip. Thus, to convert the walking soles into a carrier assembly, it is simply necessary to insert the rail into the rear opening of the slot and pull forwardly until it contacts the stop wall. To remove the handle, one slides the rail in the opposite direction. There is no need for the user to first remove the boots from the walking soles as is necessary when using a conventional boot tree.

Therefore, it is an object of this invention to provide a pair of walking soles with an improved bottom configuration which relieves stress on a walker's feet when attached to the bottom of a pair of ski boots.

Another object of the invention is to provide a pair of walking soles with improved toe and heel attachment means which can be adjusted with a minimum of difficulty.

Still another object of the invention is to provide a pair of walking soles with a detachable handle for converting the soles to a carrier assembly.

The foregoing and other objects of the present invention, as well as the invention itself, may be more fully understood from the following description when read in conjunction with the accompanying drawings.

BRIEF DESCRIPTION OF THE DRAWINGS

FIG. 1 is a perspective view showing the walking sole and carrier assembly of the present invention.

FIG. 2 is a side view showing a walking sole and boot disassembled from the carrier assembly, the broken lines showing the position of the sole and boot when the wearer's weight is shifted forwardly to take a step.

FIG. 3 is a front elevation of FIG. 1.

FIG. 4 is a perspective view showing a walking sole and handle in exploded relation to one another.

FIG. 5 is a fragmentary sectional view taken through one of the walking soles and the handle of the assembly.

DESCRIPTION OF THE PREFERRED EMBODIMENT

Referring more particularly to the drawings, FIG. 1 is a perspective view showing the walking sole and carrier assembly of the present invention, indicated in its entirety by the numeral 10, with a pair of ski boots 12 being shown in phantom. The assembly is depicted in a vertical position, which is the position in which it would be carried or in which it might be hung from a hook or storage rack (not shown). However, the assembly may also be supported in a horizontal position, with its bottom surface resting on the ground, as shown by the solid lines in FIG. 2.

The assembly includes a pair of walking soles 14, 16 which may be detachably mounted in side-by-side relationship to a central handle 18 as will be described in greater detail below. Each sole of the pair comprises a body portion having a generally flat upper face 20, a pair of opposite side walls 22, 24 and a lower tread face 26, which preferably is provided with an anti-slip tread surface 28 (shown fragmentarily in FIG. 1, and fully in FIG. 2) made of rubber, roughened plastic, or the like. The lower tread face 26 includes a planar rear surface 30 which extends horizontally along the ground when the sole is supported in a rest position as shown by the solid lines in FIG. 2, and a planar front surface 32 which defines an obtuse angle with respect to the rear surface 30. The junction of the two surfaces 30, 32 is a straight line 34 located in approximately the front third of the lower tread face 26, just below the portion of the ski boot 12 which holds the ball of the wearer's foot. The thickness of each sole 14, 16 increases linearly from the rear edge 36 of the body portion to the junction line 34, and then decreases linearly from the junction line 34 to the front edge 38. This ensures that when the wearer stands in a stationary position with the rear surface 30 of the lower face resting on the ground, the front portion of his or her feet will be elevated relative to the rear portion, thus compensating for the angular orientation of the upper portions of the boots relative to the lower portions. Therefore, the wearer is able to stand comfortably in an upright position with his or her legs perpendicular to the ground, as indicated by the broken line X—X in FIG. 2. Then, when the wearer shifts his weight forwardly to take a step, the sole will rock about junction line 34 to the position shown in phantom, in which the front surface 32 of the lower face 26 rests evenly on the ground, and the rear surface 30 is elevated therefrom. This abrupt rocking motion essentially duplicates the toe flexing which would be performed by the back foot during ordinary walking, but which is prohibited by the rigid bottoms of the ski boots 12.

In order to mount each walking sole 14, 16 securely on to the bottom of one of the wearer's ski boots 12, toe attachment means 40 are provided on the forward part of the walking sole body portion for releasably engaging the toe binding ledge 42 of the boot 12, and heel attachment means 44 are provided on the rear part of the walking sole body portion for releasably engaging the heel binding ledge 46 of the boot 12. Preferably, the toe attachment means 40 comprises a cord of strong, resilient material secured to the body portion of the sole in any suitable fashion. For instance, the two free ends of the cord may be threaded through opposite ends of a bore (not shown) which extends between the sides 22, 24 of the body portion, and then tied or otherwise fused together to prevent inadvertent detachment from the assembly. The central portion of the cord defines a loop which is stretched over the toe binding ledge 42 of the boot, so as to tightly hold the front portion of the boots in place. The heel attachment means 44 preferably comprises a rigid bail member having a central portion adapted to engage the heel binding ledge of the ski boot and a pair of leg members 47 (only one shown) depending perpendicularly from opposite ends of the central portion 45 for joining the bail member to the walking sole. A plurality of spaced apart apertures 48 is formed in the sides 22, 24 of the walking sole body portion, for removably and pivotably receiving the opposite ends of the bail member. Thus the walking soles can be adapted to fit different sized ski boots simply by moving the ends of the bail member 44 into a different pair of apertures 48 closer to or farther away from the rear edge 36 of the sole.

Detachable handle 18, which joins the walking soles 16, 18 together as a single unit and converts them into a carrier assembly or boot tree, preferably comprises an elongated lower portion 50 having spaced apart outer side walls 52, 54 each of which is adapted for connection to the inner side wall 22 of a different one of the walking soles, and an angularly disposed upper portion 56 having a hand grip 58 formed at its distal end. A bore 59 may be formed in the lower portion 50 of the handle for allowing the carrier assembly to be hung from a hook or storage rack as mentioned earlier.

The means for connecting the outer side walls 52, 54 of the handle 18 to the inner side wall of each of the walking soles comprises a rail member 60, shown here as being T-shaped in cross-section, which runs along each of the sides 52, 54 of the lower portion 50 of the handle. A channel member 62 defining a mating slot is provided on the inner side wall 22 of each walking sole for slidably receiving a corresponding one of the rail members 60. The forward end of each channel member is closed off by means of a stop wall 64 which prevents the handle 18 from being pulled out by a person lifting the assembly by the hand grip. Thus, to convert the walking soles 14, 16 into a carrier assembly, it is simply necessary to insert the rail into the rear opening of the slot and pull forwardly until it contacts the stop wall 64. To remove the handle, one slides the rail in the opposite direction. There is no need for the user to first remove the boots from the walking soles as is necessary when using a conventional boot tree.

It will be apparent to those skilled in the art that various changes, other than those already discussed may be made in the size, shape, materials, type, number and arrangement of parts described herein without departing from the spirit of the invention and the scope of the appended claims. In addition, it should be noted that the walking soles and carrier assembly need not be limited to use with ski boots, but can also be used with other types of rigid-bottomed footgear such as plaster-of-paris leg casts for medical patients and various different specialty shoes which cause discomfort in walking.

What I claim is:

1. A carrier assembly for storing and transporting rigid-bottomed footgear, said carrier assembly comprising:

(a) a pair of walking soles for attachment to the bottom of rigid-bottomed footgear, each of said walking soles including,
  (i) a body portion having a generally flat upper face for supporting said footgear, an inner side wall, an outer side wall, and a lower tread face for contacting the ground,
  (ii) toe attachment means mounted to the forward portion of said body portion for releasably engaging the forward portion of said footgear, and
  (iii) heel attachment means mounted to the rear portion of said body portion for releasably engaging the rear portion of said footgear;

(b) a handle, said handle including
  (i) an elongated lower portion having spaced apart side walls; and
  (ii) an upper portion having a handgrip formed thereon; and (c) cooperating elements of a demountable interconnection on the inner side wall of each of said walking soles and on the opposite side walls of said handle for releasably joining said walking soles in side-by-side relationship to one another and to opposite sides of the handle.

2. The carrier assembly of claim 1, in which said cooperating elements of a demountable interconnection comprise:

(a) a pair of rail members extending longitudinally with respect to said elongated lower portion of said handle;

(b) a pair of longitudinally extending channel members, each of said channel members defining a slot for slidably receiving a different one of said rail members; and (c) a stop wall formed in each channel for preventing a rail member from being pulled forwardly out of said channel.

3. The carrier assembly of claim 1, in which the lower tread face of each of said walking soles comprises:

(a) a planar rear surface;

(b) a planar front surface defining an obtuse angle with respect to said planar rear surface; and (c) a straight line junction at which said rear surface joins said front surface, said straight line junction being located in approximately the front third of said lower tread surface, in an area corresponding to the ball of a foot, the thickness of said body portion increasing linearly from the rearmost edge of said body portion to said straight line junction, and linearly decreasing from said straight line junction to the forwardmost edge of said body portion.

4. The carrier assembly of claim 1, in which the toe attachment means of each walking sole consists of a cord of strong, resilient material secured to the body portion of the sole, the central portion of said cord defining a loop for stretching over the forward portion of the footgear.

5. The carrier assembly of claim 1, the heel attachment means of each walking sole comprises:

(a) a plurality of spaced apart apertures formed in opposite sides of said body portion proximate the rear end thereof; and (b) a rigid bail member including a central portion for engaging the rear portion of said footgear and a pair of leg members depending perpendicularly from opposite ends of said central portion, each of said leg members being pivotably received in one of the apertures on opposite sides of said body, and movable to another one of said apertures in order to adapt said walking sole to different sized foot gear.

6. A walking sole and carrier assembly for ski boots of the type including a flat, substantially inflexible sole portion arranged for cooperation with the top flat surface of a snow ski, and an upper portion extending angularly forwardly at a skier's ankle, said sole portion including a front projecting ledge portion arranged for releasable engagement by the toe piece of a ski binding mechanism and a rear projecting ledge portion arranged for releasable engagement by the heel piece of said ski binding mechanism, said assembly comprising:

(a) a pair of walking soles to be attached to the sole portions of said ski boots for the purpose of compensating for the angular orientation of said upper portions of said ski boots relative to said sole portions and facilitating walking therein, each of said walking soles including, (i) a body portion having a generally flat upper face for supporting a ski boot, an inner side wall, an outer side wall, and a lower tread face for contacting the ground, said lower face including a planar rear surface and a planar front surface, said planar front surface defining an obtuse angle with respect to said planar rear surface, (ii) toe attachment means mounted towards the front of said body portion for releasably engaging the front projecting ledge portion of said ski boots; and (iii) heel attachment means mounted towards the rear of said body portion for releasably engaging the rear projecting ledge portion of said ski boot;

(b) a handle for facilitating carrying of said assembly, said handle including, (i) an elongated lower portion having spaced apart opposite side walls;

(ii) an upper portion having a hand grip formed thereon; and (c) cooperating elements of a demountable interconnection on each of the opposite side walls of said handle and on the inner side walls of each of said walking soles for detachably mounting said handle between said walking soles when said walking soles are arranged in side-by-side relationship to one another.

7. The walking sole and carrier assembly of claim 6, in which said cooperating elements of a demountable interconnection comprise:

(a) a pair of rail members extending longitudinally with respect to said elongated lower portion of said handle;

(b) a pair of longitudinally extending channel members, each of said channel members defining a slot for slidably receiving a different one of said rail members; and (c) a stop wall formed in each channel for preventing a rail member from being pulled forwardly out of said channel.

8. The walking sole and carrier assembly of claim 6, in which said planar rear surface and said planar front surface of said lower tread face of said body portion join one another at a straight line junction located in approximately the front third of the tread face, in an area corresponding to the position of the ball of said ski boot, and in which the thickness of said body portion increases linearly from the rearmost edge of said body portion to said straight line junction and decreases linearly from said straight line junction to the forwardmost edge of said body portion.

9. The walking sole of claim 6, in which said toe attachment means consists of a cord of strong, resilient material secured to the body portion of the sole, the central portion of said cord defining a loop for stretching over the forward portion of one of said ski boots.

10. The walking sole of claim 6, in which said heel attachment means comprises:

(a) a plurality of spaced apart apertures formed in opposite sides of said body portion proximate the rear end thereof; and (b) a rigid bail member including a central portion for engaging the rear portion of one of said ski boots and a pair of leg members depending perpendicularly from opposite ends of said central portion, with each of said leg members being pivotably received in one of the apertures in the opposite sides of said body and movable to another one of said apertures in order to adapt said walking sole to different sized ski boots.

11. The assembly of claim 6, in which said lower face of said body portion of each of said walking soles is provided with an anti-slip tread surface.

* * * * *